US006237767B1

(12) United States Patent
Lee

(10) Patent No.: US 6,237,767 B1
(45) Date of Patent: May 29, 2001

(54) TOOL BOX

(76) Inventor: Tze-Ming Lee, 58, Ma Yuan West St., Taichung (TW)

( * ) Notice: Subject to any disclaimer, the term of this patent is extended or adjusted under 35 U.S.C. 154(b) by 0 days.

(21) Appl. No.: 09/591,385

(22) Filed: Jun. 7, 2000

(51) Int. Cl.[7] ..... B65D 85/28

(52) U.S. Cl. ..... 206/373; 206/234; 206/818; 362/154

(58) Field of Search ..... 206/234, 372, 206/373, 573, 818; 362/154, 155

(56) References Cited

U.S. PATENT DOCUMENTS 4,855,881 * 8/1989 Pence ..... 362/154
5,221,003 * 6/1993 Chang ..... 206/573
5,344,339 * 9/1994 Cheslock ..... 206/372
5,624,029 * 4/1997 Shih ..... 206/372
5,685,421 * 11/1997 Gilmore ..... 362/156
5,967,641 * 10/1999 Sung et al. ..... 362/154
6,047,830 * 4/2000 Chang ..... 206/372

* cited by examiner

*Primary Examiner*—David T. Fidei

(57) ABSTRACT

A tool box has a base casing and an upper cover engaging with the base casing. The base casing has a plurality of grooves. The upper cover has a tank-shaped seat receiving a dish, two through holes communicating with the tank-shaped seat, a plurality of protruded bars, two lamp sockets receiving two lamps, two oblong recesses receiving two switch devices, and two oblong holes receiving two cell sockets. A dish is inserted in the tank-shaped seat. The dish has a periphery flange engaging with the protruded bars.

1 Claim, 5 Drawing Sheets

TOOL BOX

BACKGROUND OF THE INVENTION

The present invention relates to a tool box. More particularly, the present invention relates to a tool box which can receive metal articles by a magnetic force.

A conventional tool box can receive a large number of parts such as nuts, screws, and washers. However, the parts will be mixed together after the tool box is shaked while the user carry the tool box.

SUMMARY OF THE INVENTION

An object of the present invention is to provide a tool box which can receive metal articles by a magnetic force.

Another object of the present invention is to provide a tool box which can absorbed on a magnetic article by a magnetic force.

Another object of the present invention is to provide a tool box which can illuminate light.

In accordance with a first preferred embodiment of the present invention, a tool box comprises a base casing and an upper cover engaging with the base casing. The base casing has a plurality of grooves. The upper cover has a tank-shaped seat, two through holes communicating with the tank-shaped seat, a plurality of protruded bars, two lamp sockets, two oblong recesses, and two oblong holes. A dish is inserted in the tank-shaped seat. The dish has a periphery flange engaging with the protruded bars. Two magnets are inserted in the through holes of the upper cover. Two rubber casings cover the upper cover. Two lamps are inserted in the lamp sockets. Two switch devices are inserted in the oblong recesses of the upper cover. Two cell sockets are inserted in the oblong holes of the upper cover. Each of the cell sockets receives a plurality of cells.

In accordance with a second preferred embodiment of the present invention, a tool box comprises a base casing and an upper cover engaging with the base casing. The base casing has a plurality of grooves. The upper cover has two disk-shaped seats, two through holes communicating with the disk-shaped seats, a plurality of protruded bars, two lamp sockets, two oblong recesses, and two oblong holes. Two dishes are inserted in the disk-shaped seats. Each of the dishes has a periphery flange engaging with the protruded bars. Two magnets are inserted in the through holes of the upper cover. Two rubber casings cover the upper cover. Two lamps are inserted in the lamp sockets. Two switch devices are inserted in the oblong recesses of the upper cover. Two cell sockets are inserted in the oblong holes of the upper cover. Each of the cell sockets receives a plurality of cells.

DETAILED DESCRIPTION OF THE INVENTION

Figure 1:
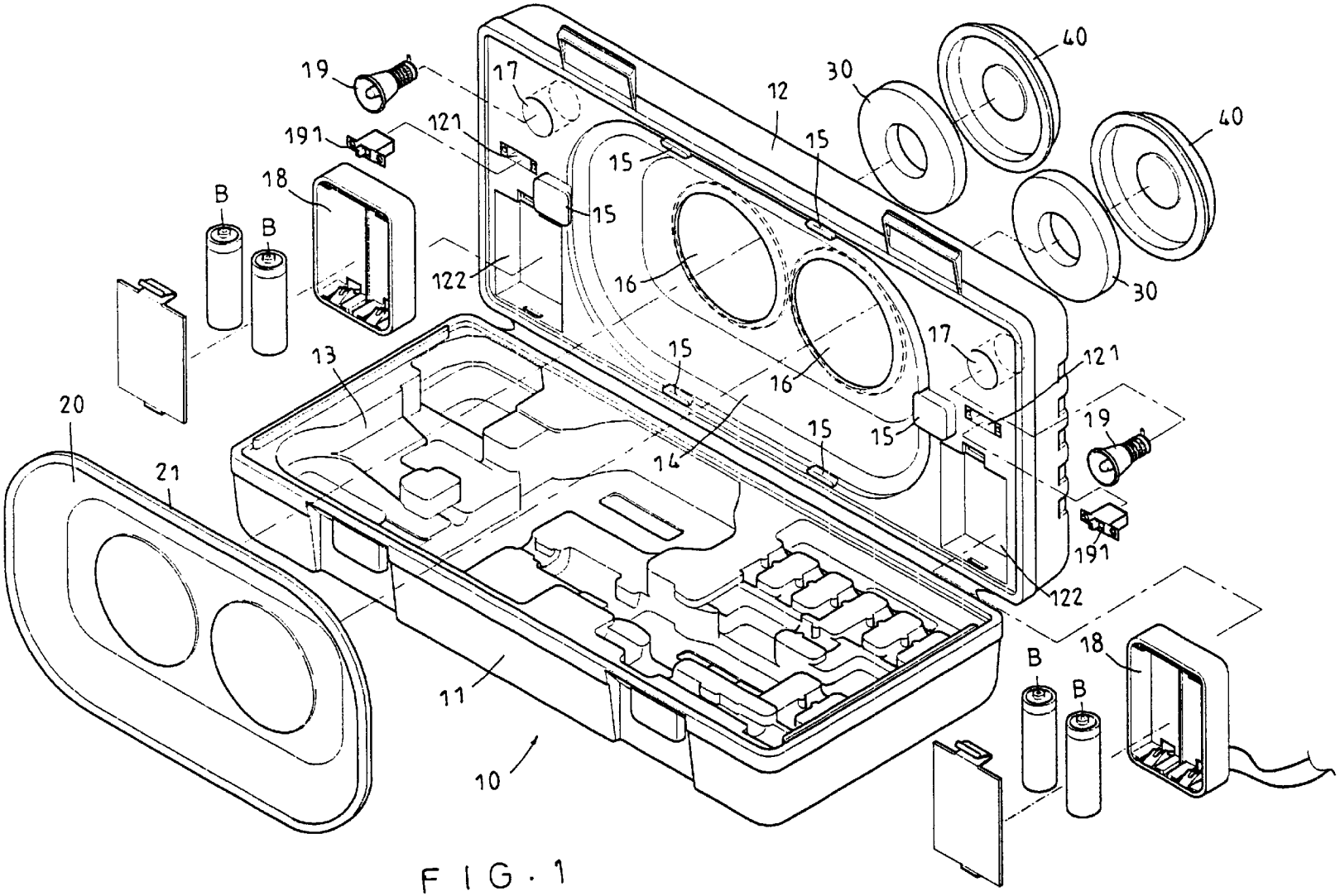
FIG. 1 is a perspective view of a tool box of a first preferred embodiment in accordance with the present invention.
Figure 4:
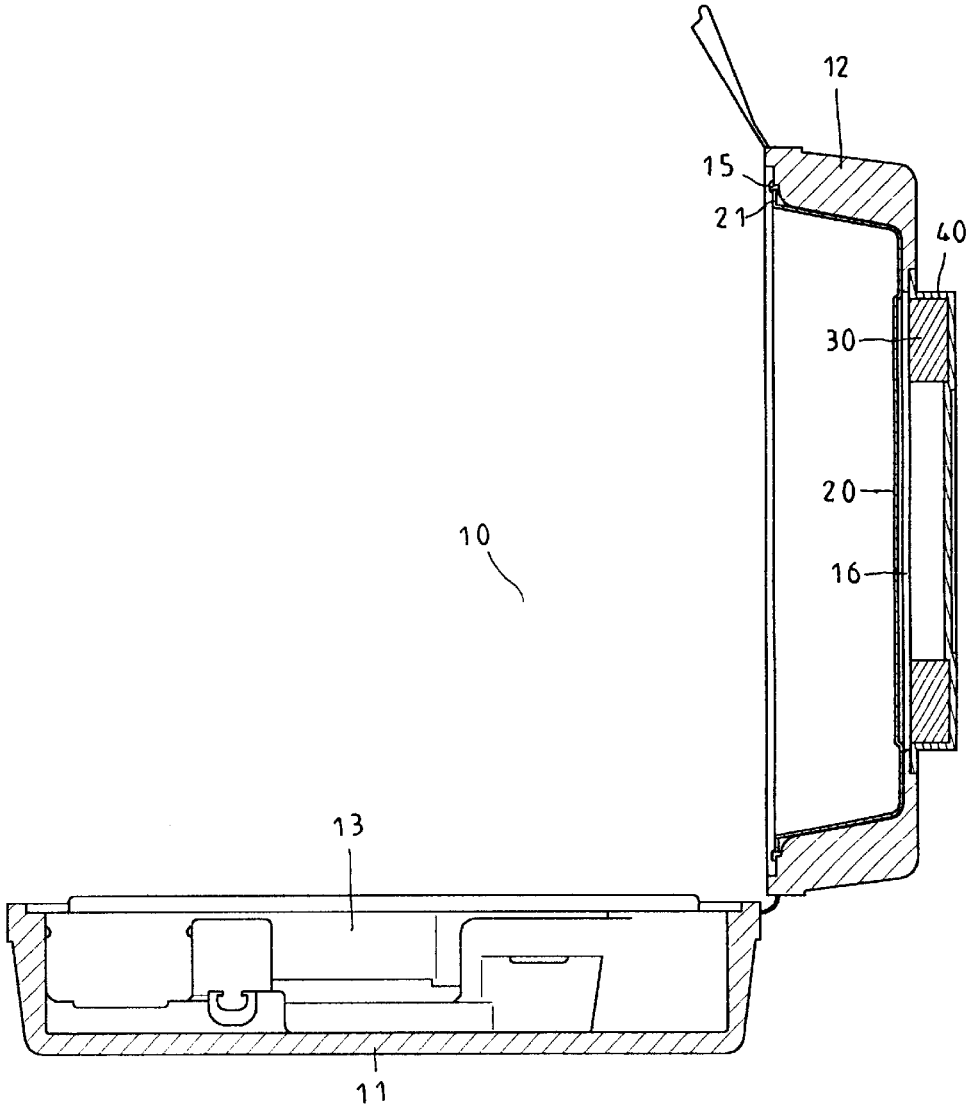
FIG. 4 is a sectional assembly view of a tool box of a first preferred embodiment in accordance with the present invention.
Figure 5:
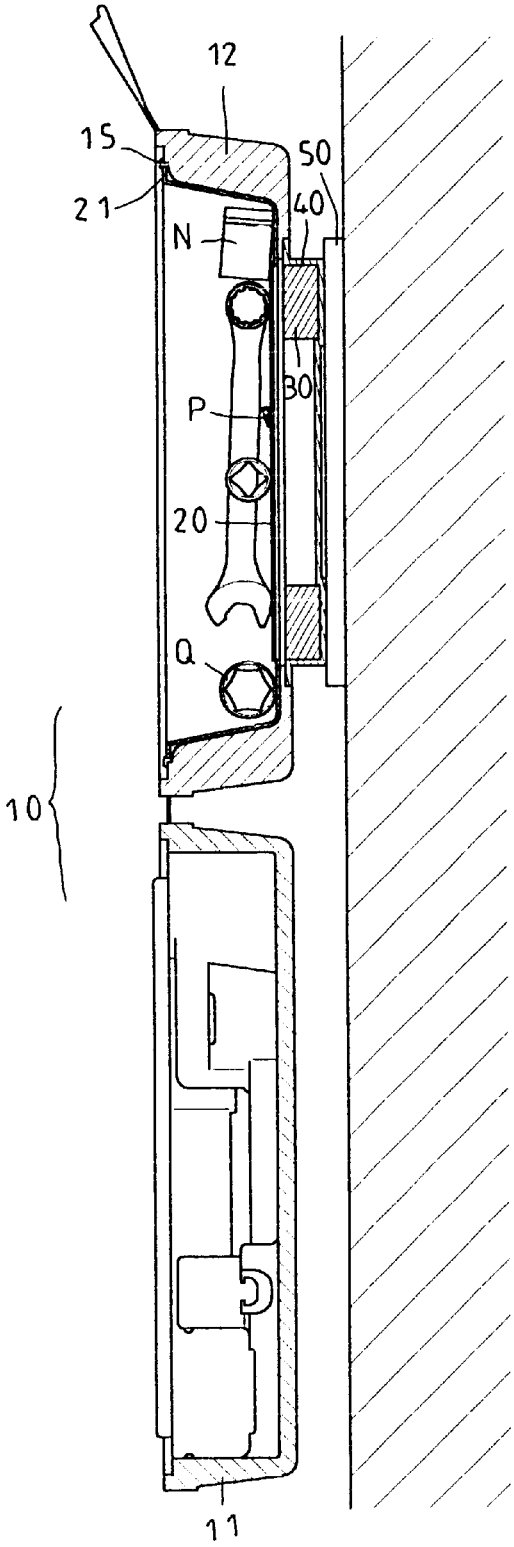
FIG. 5 is another sectional assembly view of a tool box of a first preferred embodiment in accordance with the present invention.

Referring to FIGS. 1, 4, and 5, a first tool box 10 comprises a base casing 10 and an upper cover 12 engaging with the base casing 10.

The base casing 10 has a plurality of grooves 13 for receiving parts (not shown in the figures).

The upper cover 12 has a tank-shaped seat 14, two through holes 16 communicating with the tank-shaped seat 14, a plurality of protruded bars 15, two lamp sockets 17, two oblong recesses 121, and two oblong holes 122.

A dish 20 is inserted in the tank-shaped seat 14. The dish 20 has a periphery flange 21 engaging with the protruded bars 15.

Two magnets 30 are inserted in the through holes 16 of the upper cover 12. Two rubber casings 40 cover the upper cover 12.

Two lamps 19 are inserted in the lamp sockets 17.

Two switch devices 191 are inserted in the oblong recesses 121 of the upper cover 12.

Two bell sockets 18 are inserted in the oblong holes 122 of the upper cover 12.

Each of the cell sockets 18 receives a plurality of cells B.

Referring to FIG. 4, the tool box 10 is opened.

Referring to FIG. 5, the tool box 10 is absorbed on an iron wall. A nut N, a screw P, and an iron washer Q are absorbed in the tool box 10.

Figure 2:
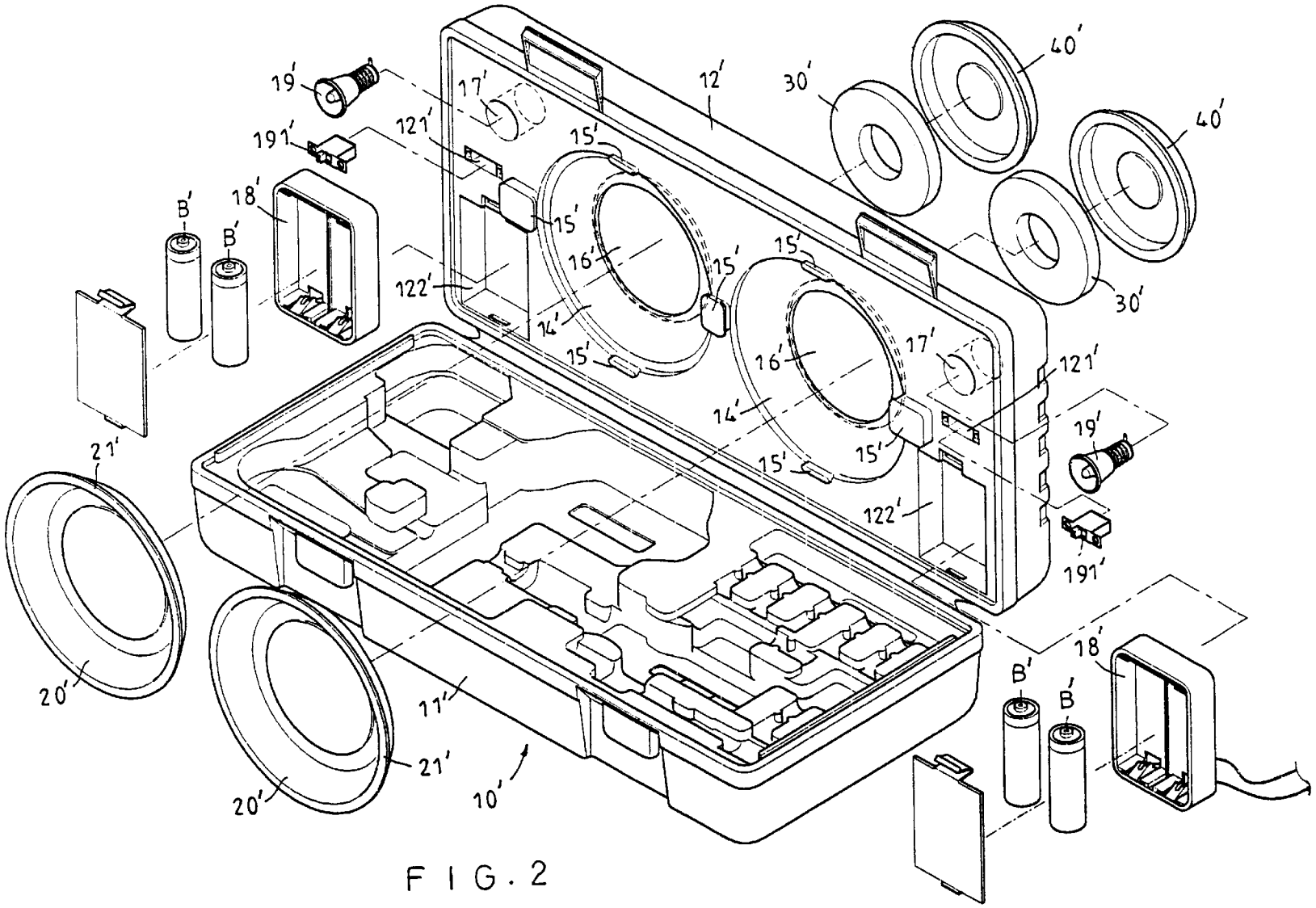
FIG. 2 is a perspective view of a tool box of a second preferred embodiment in accordance with the present invention.
Figure 3:
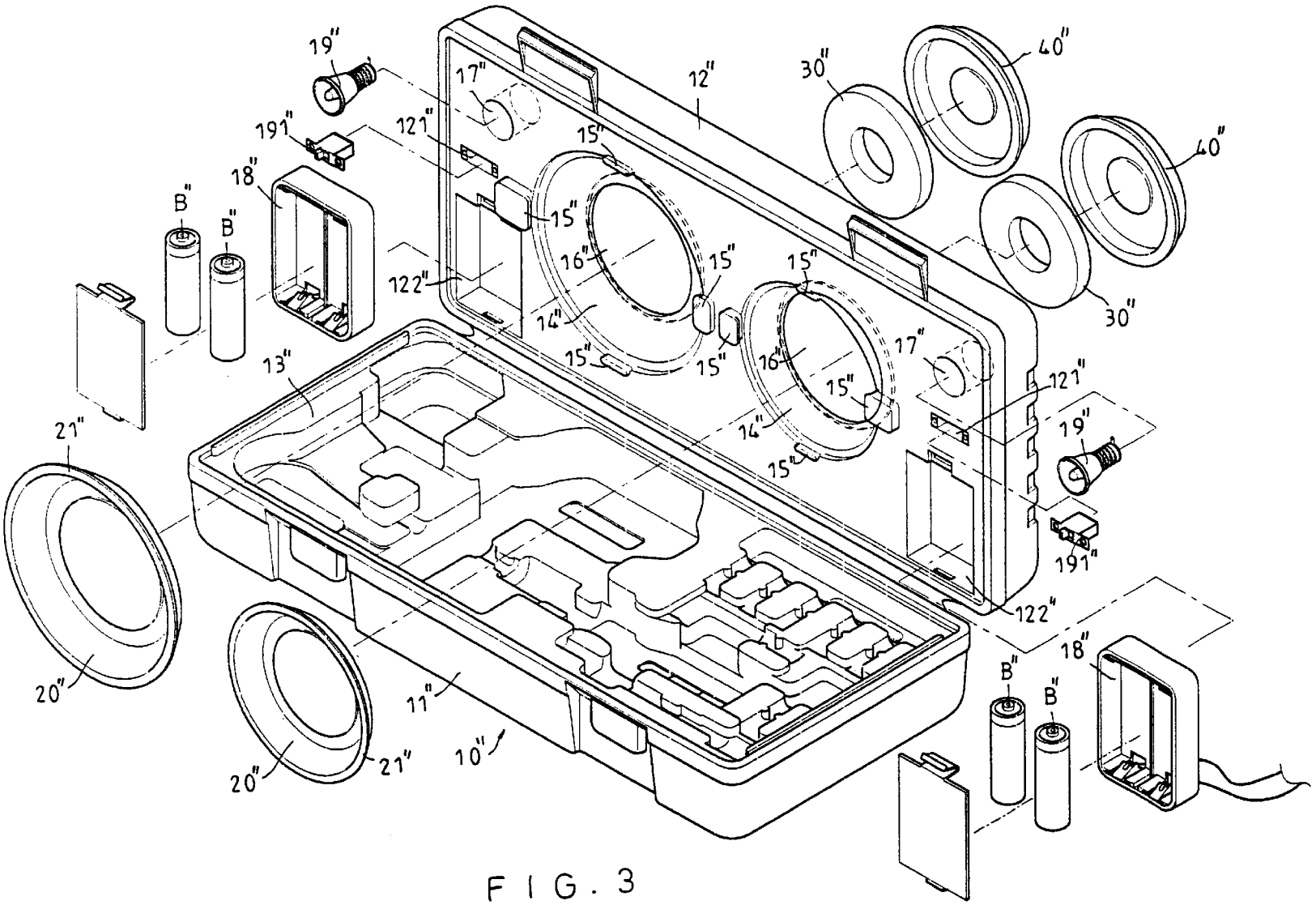
FIG. 3 is a perspective view of a tool box of a third preferred embodiment in accordance with the present invention.

Referring to FIG. 2, a second tool box 10' comprises a base casing 10' and an upper cover 12' engaging with the base casing 10'.

The base casing 10' has a plurality of grooves 13' for receiving parts (not shown in the figures).

The upper cover 12' has two disk-shaped seats 14', two through holes 16' communicating with the disk-shaped seats 14', a plurality of protruded bars 15', two lamp sockets 17', two oblong recesses 121', and two oblong holes 122'.

Two dishes 20' are inserted in the disk-shaped seats 141. Each of the dishes 20' has a periphery flange 21' engaging with the protruded bars 15'.

Two magnets 30' are inserted in the through holes 16' of the upper cover 12'. Two rubber casings 40' cover the upper cover 12'.

Two lamps 19' are inserted in the lamp sockets 17'.

Two switch devices 191' are inserted in the oblong recesses 121' of the upper cover 12'.

Two cell sockets 18' are inserted in the oblong holes 122' of the upper cover 12'.

Each of the cell sockets 18' receives a plurality of cells B'.

Referring to PIG. 3, a third tool box 10" comprises a base casing 10" and an upper cover 12" engaging with the base casing 10".

The base casing 10" has a plurality of grooves 13" for receiving parts (not shown in the figures).

The upper cover 12" has two disk-shaped seats 14", two through holes 16" communicating with the disk-shaped seats 14", a plurality of protruded bars 15", two lamp sockets 17", two oblong recesses 121", and two oblong holes 122".

Two dishes 20" are inserted in the disk-shaped seats 14". Each of the dishes 20" has a periphery flange 21" engaging with the protruded bars 15".

Two magnets 30" are inserted in the through holes 16" of the upper cover 12". Two rubber casings 40" cover the upper cover 12".

Two lamps 19" are inserted in the lamp sockets 17".

Two switch devices 191" are inserted in the oblong recesses 121" of the upper cover 12".

Two cell sockets 18" are inserted in the oblong holes 122" of the upper cover 12".

Each of the cell sockets 18' receives a plurality of cells B".

The invention is not limited to the above embodiment but various modification thereof may be made. Further, various changes in form and detail may be made without departing from the scope of the invention.

I claim:

1. A tool box comprises:

a base casing and an upper cover engaging with the base casing, the base casing having a plurality of grooves, the upper cover having a tank-shaped seat, two through holes communicating with the tank-shaped seat, a plurality of protruded bars, two lamp sockets, two oblong recesses, and two oblong holes, a dish inserted in the tank-shaped seat, the dish having a periphery flange engaging with the protruded bars, two magnets inserted in the through holes of the upper cover, two rubber casings covering the upper cover, two lamps inserted in the lamp sockets, two switch devices inserted in the oblong recesses of the upper cover, two cell sockets inserted in the oblong holes of the upper cover, and each of the cell sockets receiving a plurality of cells.

* * * * *